United States Patent [19]

Wade

[11] 4,360,293

[45] Nov. 23, 1982

[54] CANAL PAVING MACHINE

[75] Inventor: Arthur W. Wade, Ida Grove, Iowa

[73] Assignee: Gomaco, Inc., Ida Grove, Iowa

[21] Appl. No.: 178,987

[22] Filed: Aug. 18, 1980

[51] Int. Cl.[3] ..... E02B 5/02

[52] U.S. Cl. ..... 405/268; 404/96

[58] Field of Search ..... 404/96, 84, 104, 105, 404/98, 108, 101; 405/268; 280/638; 180/41, 9.52, 9.46

[56] References Cited

U.S. PATENT DOCUMENTS

| | | | |
|---|---|---|---|
| 2,410,271 | 10/1946 | Davidson et al. | 280/638 X |
| 2,412,398 | 12/1946 | Harsch | 404/114 X |
| 2,598,903 | 6/1952 | Gebhard | 405/268 |
| 3,158,945 | 12/1964 | Curlet et al. | 404/84 X |
| 3,247,771 | 4/1966 | Hanson | 405/268 X |
| 3,328,902 | 7/1967 | Hanson | 404/96 X |
| 3,540,360 | 11/1970 | Snow et al. | 404/84 |
| 3,774,401 | 11/1973 | Allen | 404/84 X |
| 4,029,165 | 6/1977 | Miller et al. | 404/84 X |
| 4,197,032 | 4/1980 | Miller | 404/105 X |

FOREIGN PATENT DOCUMENTS

| | | | |
|---|---|---|---|
| 2448654 | 4/1975 | Fed. Rep. of Germany | 280/638 |
| 1437821 | 6/1976 | United Kingdom | 404/104 |

*Primary Examiner*—William F. Pate, III

*Attorney, Agent, or Firm*—Rudolph L. Lowell

[57] ABSTRACT

The canal paving machine has an elongated main frame supported in an elevated position on a pair of end frame structures each of which includes an upper mounting section, a lower traction section and an intermediate connecting section. One mounting section is movably supported on the main frame for movement longitudinally thereof to vary the longitudinal spacing between the end frame structures. Each traction section has front and rear traction units movably connected together to vary the spacing therebetween transversely of the main frame. The connecting section is vertically adjustable relative to the traction section and the upper mounting section is vertically adjustable relative to the connecting section. During a paving operation the upper sections are retracted relative to the connecting sections and the main frame adjusted relative to the ground surface by vertical adjustment only of the connecting sections. For attaching or removing a slip form from the underside of the main frame, the upper sections and connecting sections of the end frame structures are vertically moved to their maximum elevations to provide adequate working space below the main frame.

5 Claims, 16 Drawing Figures

CANAL PAVING MACHINE

BACKGROUND OF THE INVENTION

Machines for paving canals, ditches and the like generally comprise an elongated main frame supported in an elevated position on a pair of end frame structures for extension transversely of and above a ditch. The end frame structures are usually adjustable longitudinally of the main frame to accommodate ditches or canals of different widths and for transport of the machine on flat beds and the like. In the operation of the machine, the main frame is vertically adjustable in a following relation with a ditch grade reference point. However this adjustment is generally limited and inadequate to elevate the main frame to a height sufficient to provide adequate working space thereunder for the mounting on or removal of a slip form from the underside of the main frame. Appreciable time is thus required in jacking up or otherwise raising the machine for form handling purposes. Additionally, the machines are without relative adjustment of the front and rear traction units transversely of the main frame for operational stability.

SUMMARY OF THE INVENTION

The invention provides a ditch or canal paving machine which is economical in cost, efficient in operation, readily transportable from one job location to another, and of a construction to provide full accessibility to the underside of the machine for changing molds or forms. End frame structures supported on front and rear traction units have interconnected lower vertically adjustable units and upper vertically adjustable units which are separately adjustable to fully extended positions providing for a maximum elevation of the machine main frame for removing molds from or mounting molds on the underside thereof. During a paving operation, only the lower vertically adjustable units are contracted and extended in response to ditch grade variations to vary the ground clearance of the main frame. At any vertically adjusted position of the main frame, one of the end frame structures is adjustable longitudinally of the main frame to vary the traction tread of the machine to accommodate ditches of different width. The front traction units are adjustable transversely of the main frame relative to the rear traction units to increase the stabilization of the machine during positioning of the machine over a ditch and during a paving operation.

DESCRIPTION OF THE INVENTION

Figure 1:
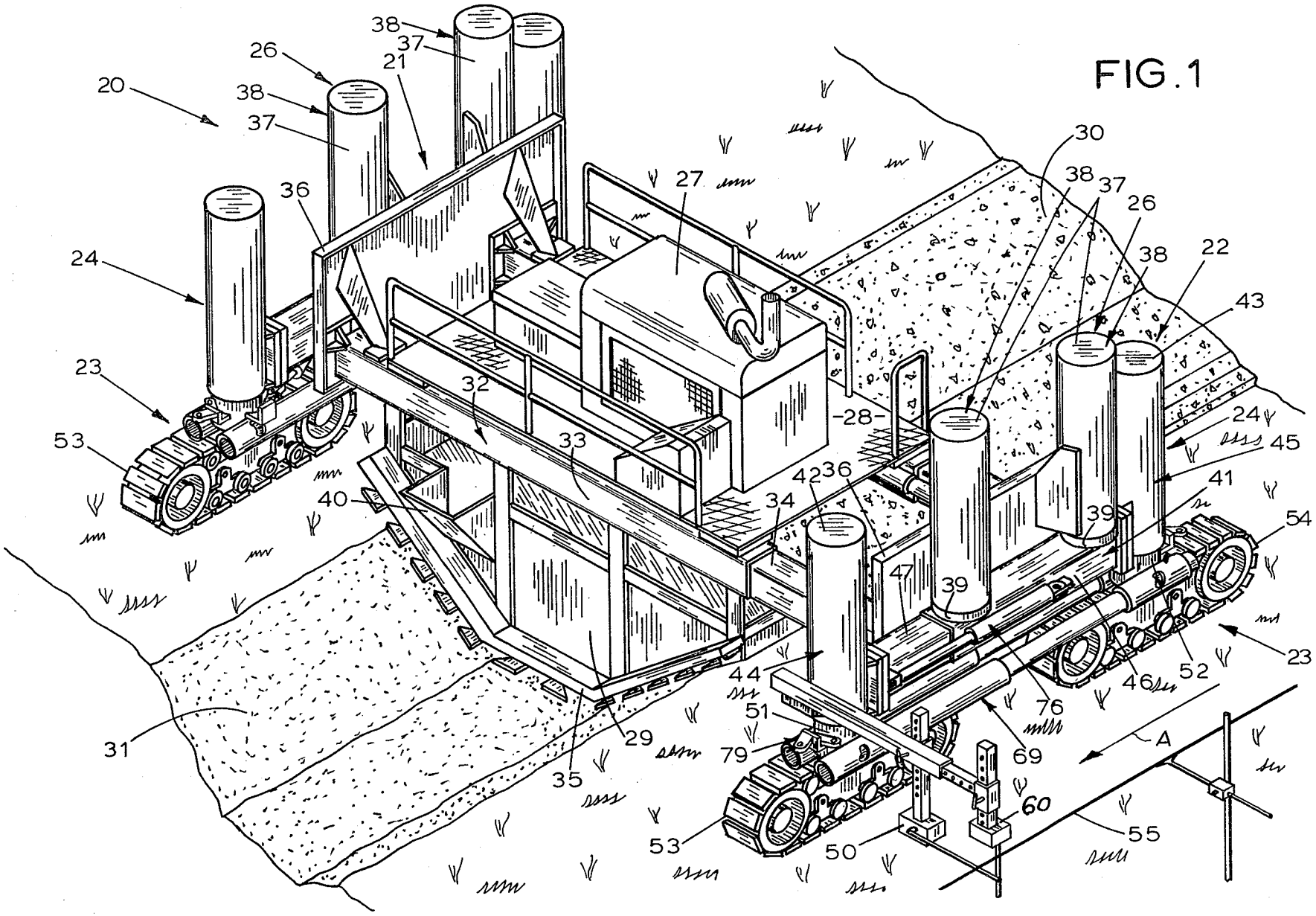
FIG. 1 is a front perspective view of the machine of this invention shown in operating position relative to a canal being paved.

Referring to the drawings, the canal paving machine is shown in FIG. 1 as including a main frame 20 supported on vertically adjustable upright end frame structures 21 and 22 each of which includes a lower traction section 23, an intermediate adjustable connecting section 24, and an upper mounting section 26. The main frame 20 carries a power unit 27 and an operator's platform 28 provided with controls (not shown) for operating the machine. A mold or slip form 29 is supported from the underside of the main frame 20 for the laying of a concrete foundation or trough 30 in a previously roughly prepared trench or canal 31. The trench may be finally prepared by a trimmer mechanism, indicated at 35, mounted on the lower front side of the form 29. Concrete is supplied in any suitable manner to a hopper 40 on the slip form 29 from a cement truck (not shown) or the like which travels along the canal 31 with the paving machine in the direction of the arrow A, during a paving operation.

The main frame 20 includes a pair of transversely spaced longitudinally extended beam units 32 of a tubular construction. Each beam unit 32 (FIGS. 1 and 4) is composed of a pair of beam sections 33 and 34 with a section 34 receivable in a telescopic relation within the section 33 for extension and contraction relative thereto. A transversely extended upright mounting plate 36 is extended between and connected to the opposite ends of the telescoping beam units 32. The plates 36 constitute transverse end members of the main frame 20 and are also a part of the end frame structures 21 and 22. Since these frame structures are similar in construction and in operation, only the end frame structure 22 will be described in detail with like numbers being used to designate like parts in the end frame structure 21.

Figure 15:
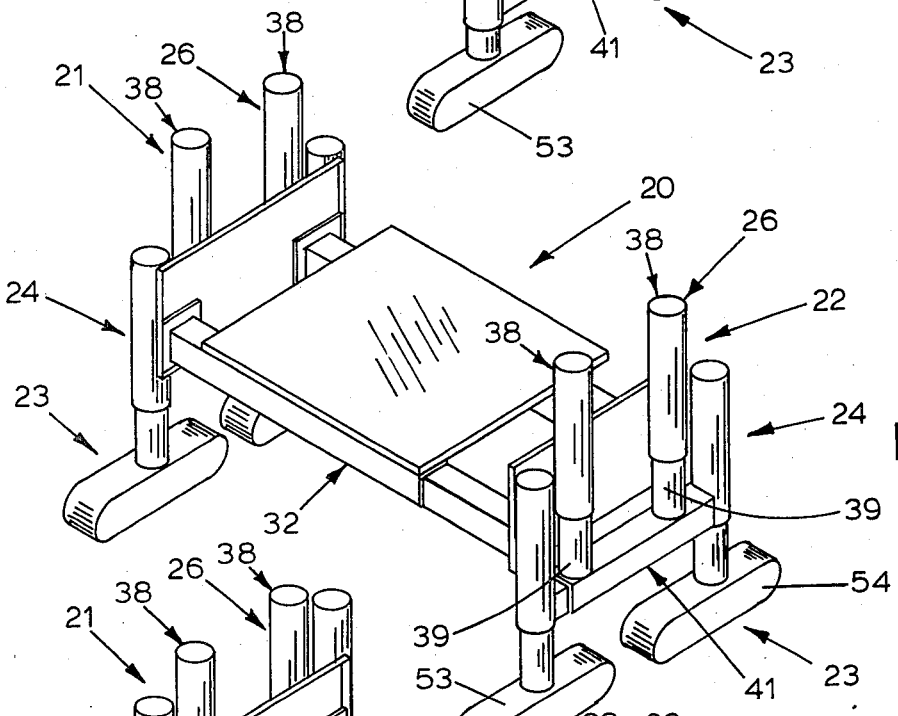
FIG. 15 is a diagrammatic illustration similar to FIG. 14 showing the end frame structures vertically extended to facilitate the mounting of a form on or removal from the underside of the main frame.

The mounting plate 36 forms part of the upper section 26 of the end frame structure 22, which upper section also includes cylinder members 37 of a pair of upper transversely spaced cylinder assemblies 38 having associated piston members 39 (FIGS. 1 and 15). The cylinder members 37 are secured to the outer side of the mounting plate 36. The piston members 39 of the cylinder assemblies 39 form part of the intermediate section 24 of the end frame structure 22 which section further includes a transversely extended adjustable beam assembly 41 and the cylinder members 42 and 43 of a pair of lower cylinder assemblies 44 and 45, respectively, transversely spaced a distance apart to receive the cylinder assemblies 38 therebetween. The adjustable beam assembly 41 is of a tubular construction and includes a beam section 46 for telescopically receiving in the front end thereof a beam section 47. The cylinder member 42 of the front cylinder assembly 44 is secured to the outer or front end of the telescoping beam section 47 and the cylinder member 43 of the rear cylinder assembly 45 is secured to the rear end of the beam section 46.

The associated piston members 51 and 52 for the cylinder members 42 and 43, respectively, form part of the lower traction section 23 of the end frame structure 22 which further includes front and rear traction units 53 and 54, respectively, of endless track type. The piston members 51 and 52 are mounted on the traction units 53 and 54, respectively.

As thus far described, it is seen that the tread of the paving machine may be varied by the extension and retraction of the main frame beam sections 34 relative to the beam sections 33 for movement of the end frame structure 22 toward and away from the end frame structure 21. On extension and retraction of the transverse beam section 47 relative to the associated beam section 46, the rear traction units 54 are moved toward and away from the front traction units 53. The main frame 20 is thus longitudinally adjustable to vary the wheel or track tread of the machine and is laterally adjustable on movement of the rear traction units 54 toward and away from the front traction units 53 to increase lateral stability of the machine when in use.

Figure 14:
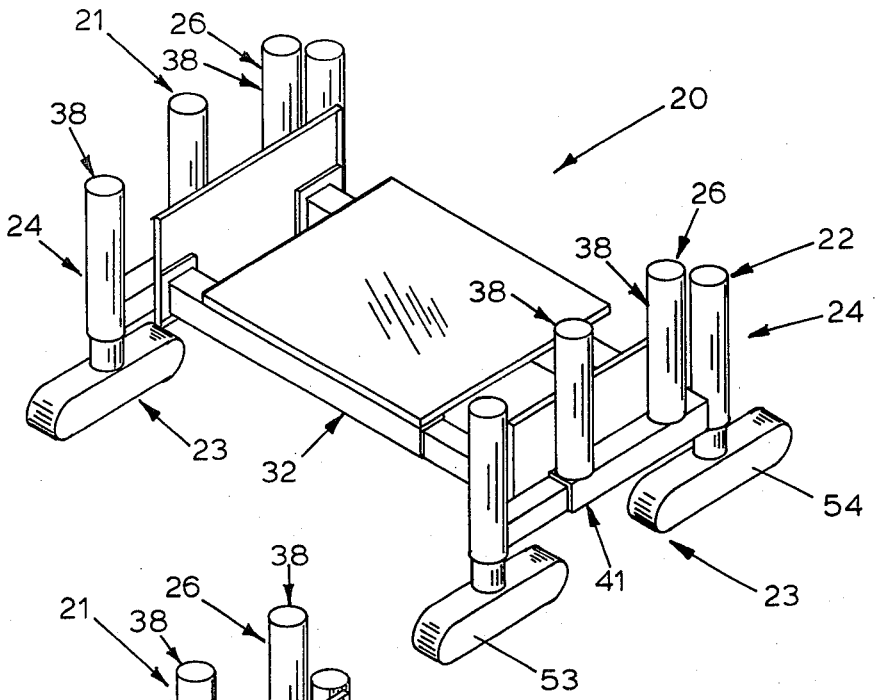
FIG. 14 is a diagrammatic illustration showing the adjusted position of the end frame structures relative to the main frame when the machine is in a paving operation and wherein the main frame is longitudinally extended.

In use of the machine in a paving operation and as shown in FIGS. 1 and 14, the telescopic beam assemblies 32 and 41 are extended and the cylinder assemblies 38 are retracted so that the intermediate section 24 and upper section 26 of the end frame structures 21 and 22 are movable as a unit with the main frame 20 by the extension and retraction of the cylinder assemblies 44 and 45 which are actuated by a sensor 50 in response to grade variations in the grade line 55 of the ditch or trench 31 being paved. The machine is steered in a usual manner by a "skid steering" of the traction units 53 and 54.

Figure 5:
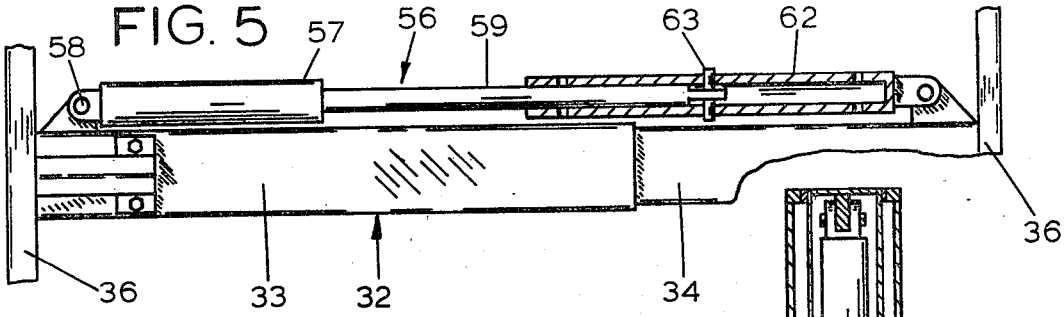
FIG. 5 is a reduced plan view of FIG. 4 showing the adjusting cylinder for moving the end frame structure; with some parts shown in section for clarity.

To extend and retract the beam sections 34 of the longitudinal beam units 32 of the main frame 20, each beam unit is equipped with an associated hydraulic cylinder assembly 56 (FIG. 5) extended in a spaced relation longitudinally thereof. The cylinder member 57 of the assembly 56 is pivoted at 58 to the beam section 33. The piston member 59 is slidably movable within a tubular guide member 62 secured at one end to the mounting plate 36. On actuation of the cylinder assembly 56, the piston member 59 is moved to an adjusted position within the guide member 62 for a pin and selected aligned hole connection therewith, as indicated at 63. By successively moving the piston within the tube 62 to connected positions therewith at the connections 63, the beam section 34 is movable in a stepped operation to retracted and extended positions therefor.

To move a front traction unit 53 relative to the rear traction unit 54 of a lower section 23 of an end frame structure, the section 23 (FIGS. 2 and 3) has a pair of similar stabilizing or aligning units 69 arranged at opposite sides of the lower section 23 at positions adjacent the upper ends of associated traction units 53 and 54. Each traction unit has a mounting bracket structure 66 of a generally inverted U-shape in transverse cross section arranged in a straddling relation with the upper end of a traction unit with the depending leg sections 67 pivotally supported at 68 for pivotal movement about an axis extended transversely of the traction unit. Each leg section 67 carries an alignment sleeve 71 and 72 for the traction units 53 and 54, respectively. A tubular aligning or stabilizing member 73 has the opposite ends thereof guidably supported within each associated pair of alignment sleeves 71 and 72. When the front traction unit 53 is to be moved to an adjusted position relative to a rear traction unit 54, the aligning member 73 is loosely received within the sleeves 71 and 72. With a front traction unit 53 in an adjusted position relative to a rear traction unit 54, as illustrated in FIG. 2, the aligning member 73 is secured to associated alignment sleeves 71 and 72 by a clamping means 74 or the like, to hold the traction units 53 and 54 in longitudinal alignment against rotational movement relative to the axes of the cylinder assemblies 44 and 45.

Adjustment of the rear traction unit 54 relative to an associated front traction unit 53 takes place by telescopic adjustment of the beam assemblies 41. The telescopic beam section 47 is moved relative to the beam section 46 of a beam assembly 41 by means of an hydraulic cylinder assembly 76 extended longitudinally of a beam assembly 41 with one end thereof pivoted at 77 to the beam section 46 and the piston end thereof pivotally connected at 78 to the cylinder member 42 of the front cylinder assembly 44.

Figure 4:
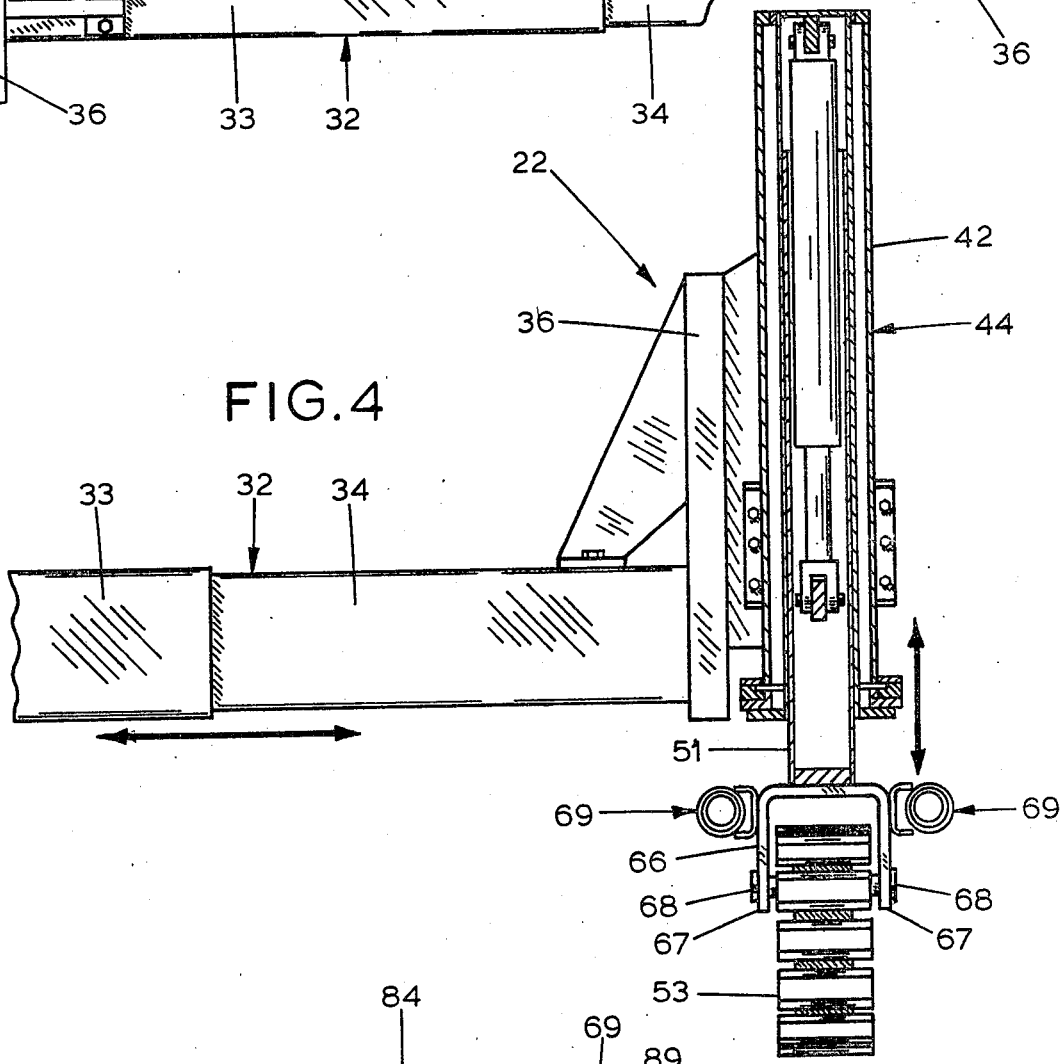
FIG. 4 is a front elevational view of the end frame structure of FIG. 2 showing the adjustable assembly thereof with the main frame of the machine for movement longitudinally of the main frame.

In each of the cylinder assemblies 44 and 45, and as shown in FIG. 4 for the cylinder assembly 44, the piston members 51 and 52 of the cylinder assemblies 44 and 45 are rotatable within the associated cylinders 42 and 43 therefor about an axis extending longitudinally of the cylinder assembly. This rotational movement is prevented by the alignment or stabilizing assemblies 69 so that a corresponding pair of traction units 53 and 54 are rigidly connected together in the plane of an associated end frame structure. Thus, as previously mentioned, steering of the paving machine, during a canal paving operation, is obtained by "skid steering" wherein the traction units 53 and 54 at opposite ends of the paving machine are driven at different rotational speeds in response to the steering sensor 60 (FIG. 1). Thus if the paving machine, as viewed in FIG. 1, is to be steered to the left, the traction units 53 and 54 at the right hand side of the machine would be driven at a faster rate than the traction units at the left hand side of the machine.

Figure 2:
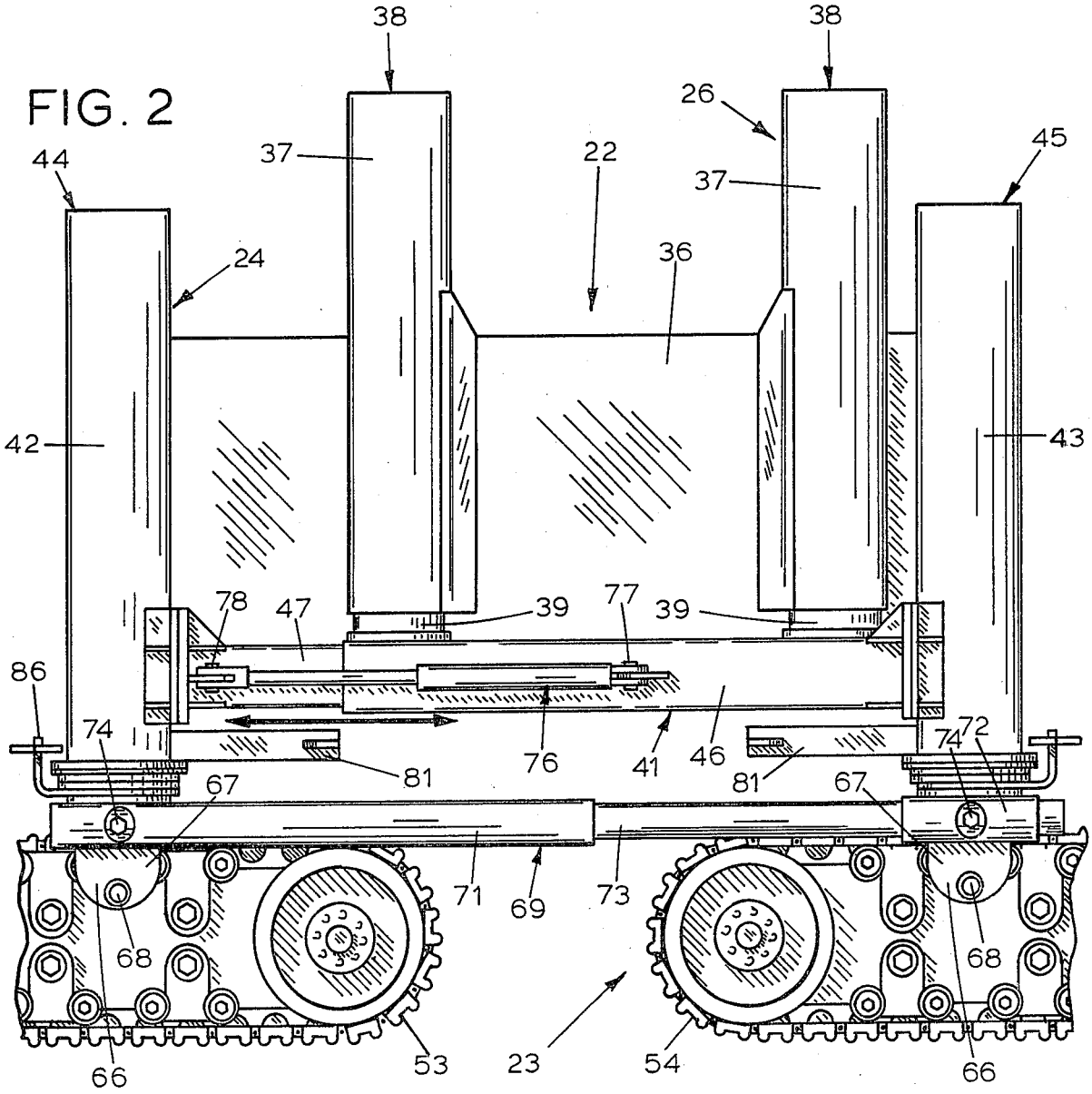
FIG. 2 is an enlarged side elevational view of an end frame structure that forms part of the machine.

Referring to FIG. 2, and as previously noted, the intermediate section 24, upper section 26 and main frame 20 of the machine are vertically movable as a unit relative to the lower section 23 in response to the extension and retraction of the pistons 51 and 52 relative to their associated cylinder members 42 and 43, respectively. In this operation of the machine, associated pairs of traction units 53 and 54 are connected together against relative pivotal movement by the stabilizing assemblies 69.

To provide adequate working space to the underside of the main frame 20, for the purpose of removing or mounting a slip form 29 on the machine, the upper section 26 (FIG. 15) is fully extended relative to the intermediate section 24 and the intermediate section 24 in turn is fully extended relative to the lower section 23 along with the beam units 32 being adjusted to fully extended positions therefor. The traction units 53 and 54 are retained in relative longitudinally aligned positions by the stabilizing assemblies 69.

Figure 16:
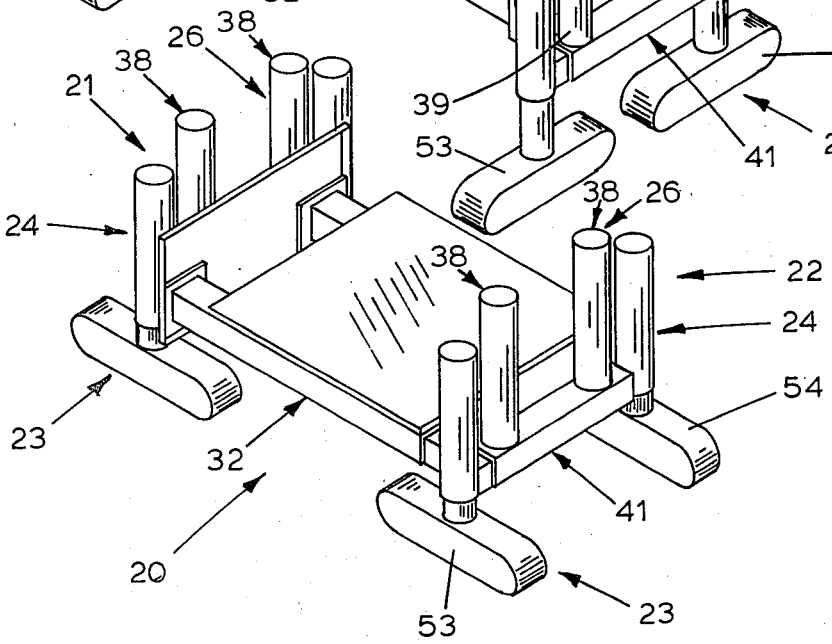
FIG. 16 is a diagrammatic illustration similar to FIG. 14 showing the end frame structures and main frame fully contracted and the traction units extended longitudinally of the main frame for transport of the machine.

When the machine 20 is to be transported on a flat bed truck or the like, the traction units 53 and 54 are turned, so as to extend longitudinally of the machine, along with the retraction of the beam assembly 41 so as to reduce to a minimum the overall transverse dimension of the machine. To facilitate turning of the traction units 53 and 54 from the operating positions therefor, shown in FIGS. 1 and 14, to their transport positions, shown in FIG. 16, a turning mechanism 79 is provided for each of the cylinder assemblies 44 and 45. Since the turning mechanisms 79 are of a similar construction and similarly associated with a cylinder assembly 44 and 45, only the turning mechanism 79 for the cylinder assembly 44 will be described in detail.

Figure 3:
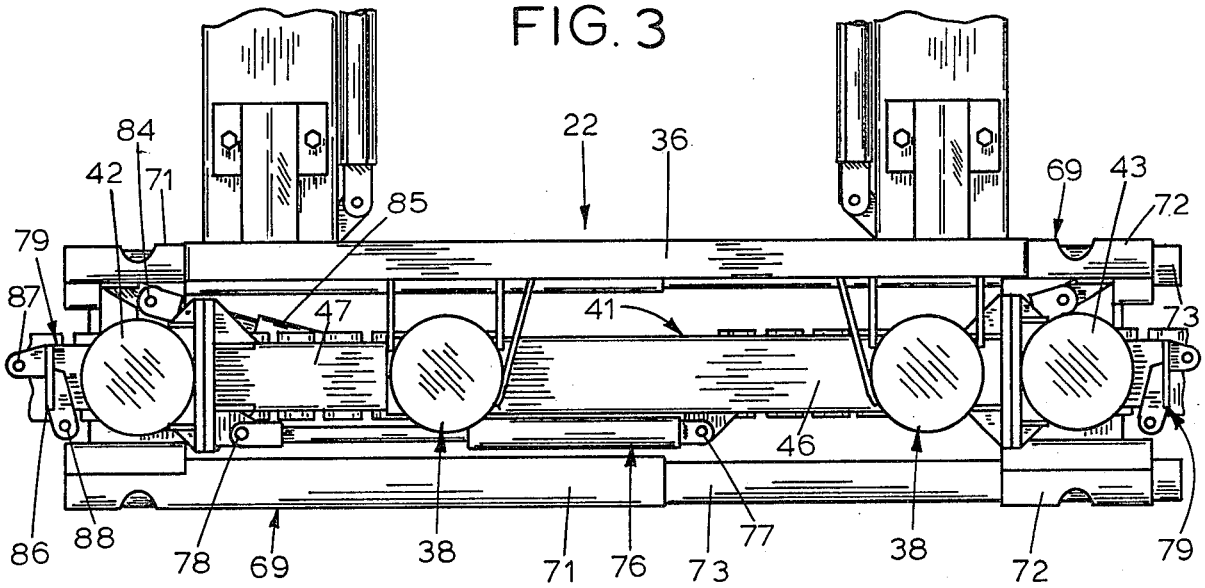
FIG. 3 is a plan view of the end frame structure shown in FIG. 2.
Figure 6:
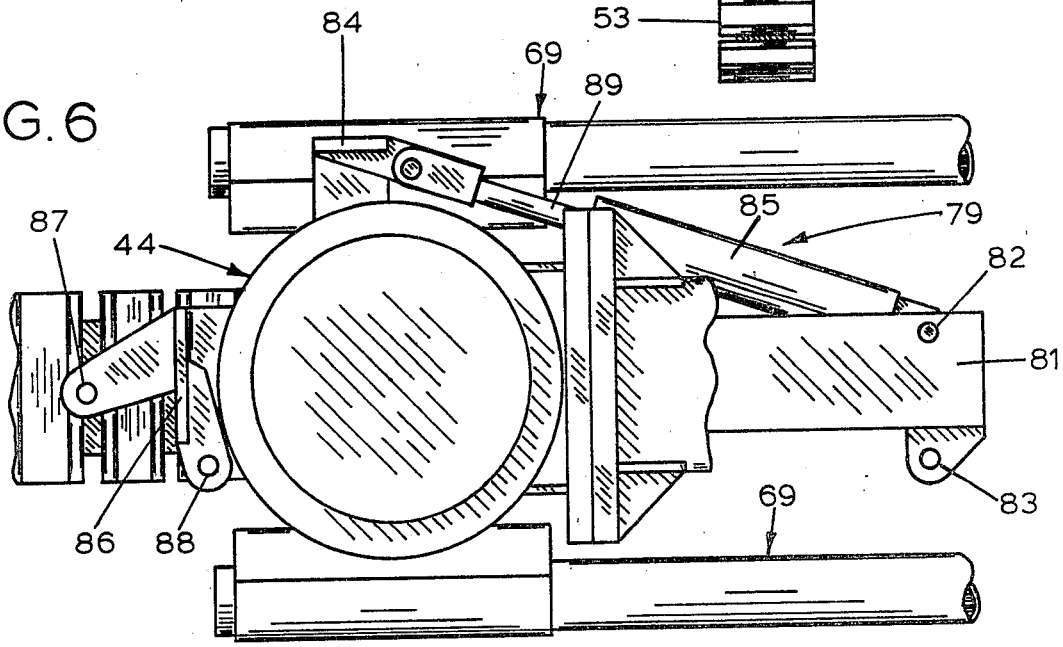
FIG. 6 is an enlarged detail plan view of a traction unit showing the mechanism for turning the traction unit between an operating position and a transport position.
Figure 7:
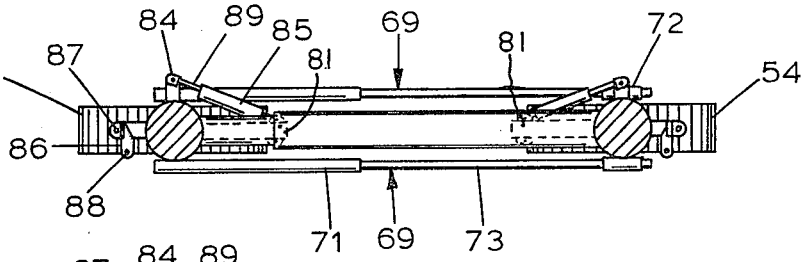
FIGS. 7–13 illustrate diagrammatically the successive positions assumed by a traction unit during its turning movement between an operating position and a transport position.
Figure 8:
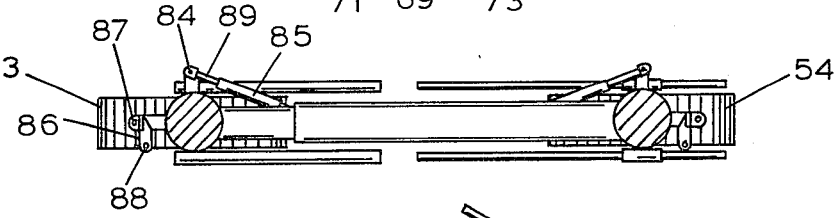
Figure 9:
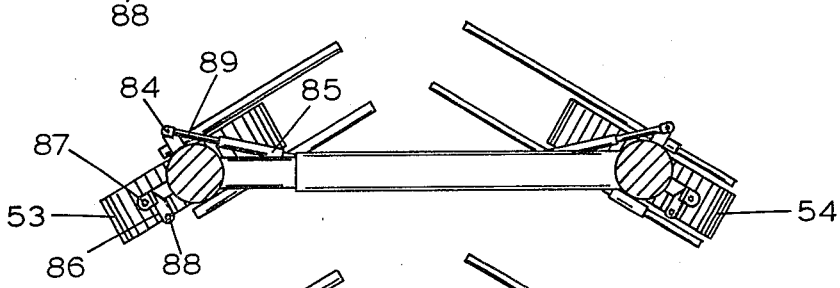
Figure 10:
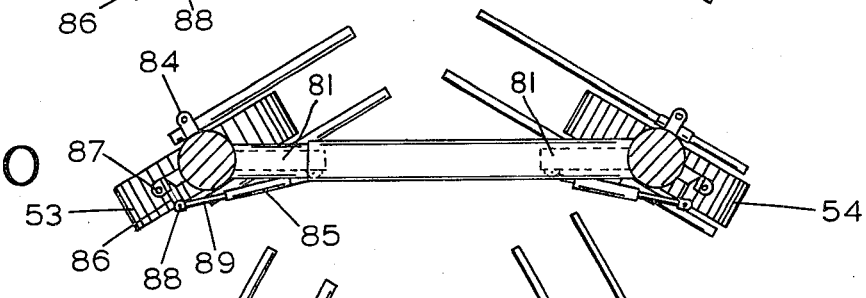
Figure 11:
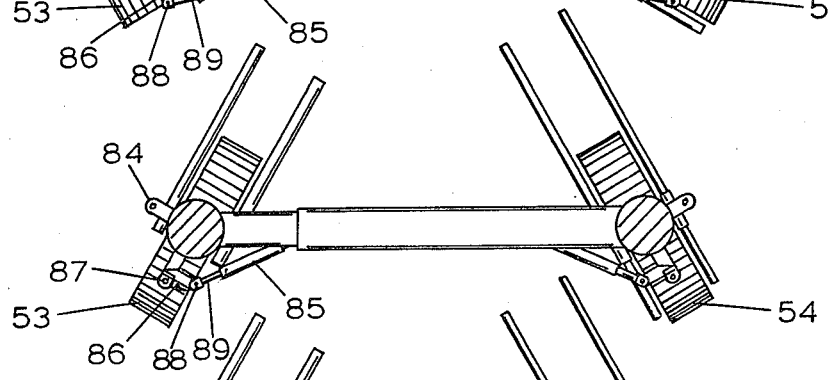

Referring to FIGS. 2, 3 and 6, the turning mechanism 79 is illustrated as including a cylinder mounting member 81 projected rearwardly from the cylinder assembly 44 and provided at its rear end with transversely spaced cylinder supports 82 and 83. Secured to the piston 51 for the front cylinder member 42 are a side cylinder mount 84 and a front cylinder mount 86 when the front traction unit 53 is extended transversely of the machine. The front mount 86 has a pair of cylinder connections 87 and 88. The turning mechanism 79 as shown in FIGS. 3 and 6, and diagrammatically in FIG. 7, includes a normally retracted cylinder assembly 85 extended between and pivotally connected to the cylinder supports 82 and 84. With the stabilizing members 73 disconnected from an alignment sleeve 71 or 72 (FIG. 8) the cylinder 85 (FIG. 9) is fully extended so as to move an associated traction unit from the position thereof in FIG. 8 to the position thereof in FIG. 9. A cylinder 85 is then disconnected from the supports 82 and 84 for connection to the supports 83 and 88, as shown in FIG. 10. When thus connected, a cylinder 85 is retracted to move an associated traction unit to the position therefor shown in FIG. 11.

Figure 12:
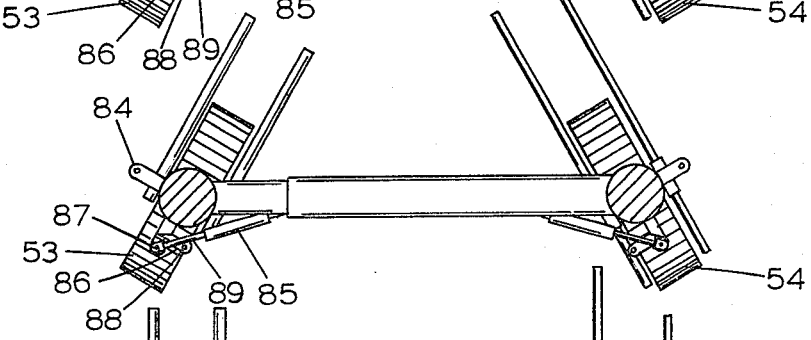
Figure 13:
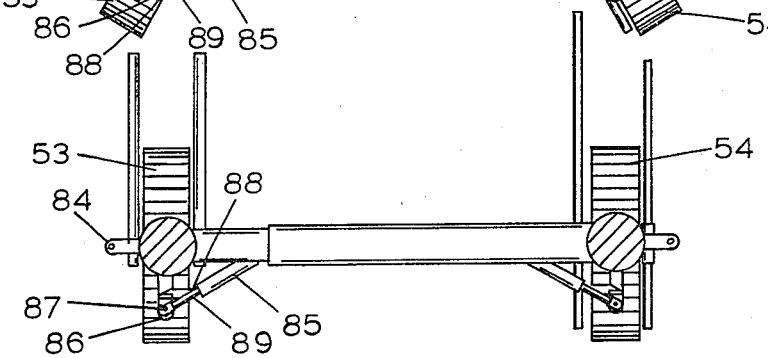

With the cylinder 85 in an extended position therefor, its associated piston 89 is disconnected from the support 88 and connected to the support 87 of the mounting 86 as illustrated in FIG. 12. On retraction of a cylinder 85 to its position shown in FIG. 13, an associated traction unit is moved to a position extended longitudinally of the paving machine. It is seen, therefore, that turning movement of a traction unit 53 and 54 is accomplished in successive steps by a relative assembly of the cylinder 85 with its associated supports 81, 84 and 86. These steps would take place in a reverse order when the traction units are to be positioned transversely of the paving machine.

Although the invention has been described with respect to a preferred embodiment thereof, it is to be understood that it is not to be so limited since changes and modifications can be made therein which are within the full intended scope of the invention as defined by the appended claims.

I claim:

1. A canal paving machine comprising:

(a) an elongated main frame having a slip form mountable from the under side thereof;

(b) a pair of upright end frame structures for supporting the main frame in a position transversely of and above a canal to be paved, each end frame structure including an upper mounting section, a lower traction section and an intermediate connecting section;

(c) means movably supporting the upper section of one of said end frame structures on the main frame for movement of said one end frame structure longitudinally of the main frame to vary the traction tread of the machine;

(d) first coacting means on the lower section and intermediate section for vertically moving the intermediate section and upper section as a unit relative to the lower section, and (e) second coacting means on the upper section and the intermediate section for vertically moving the upper section relative to the intermediate section and to the lower section as a unit, (f) said first coacting means being alone operable during a paving operation in response to grade variations in the grade line of the canal being paved, and said first coacting means, and second coacting means being operable to extended positions therefor when a slip form is to be mounted on or removed from the main frame.

2. The canal paving machine according to claim 1 wherein:

(a) each of said lower sections includes a front traction unit and a rear traction unit; and (b) means movably supporting each front traction unit on an intermediate section for adjustable movement transversely of the main frame relative to an associated rear traction unit.

3. The canal paving machine according to claim 2 wherein:

(a) said front traction units and rear traction units are of endless track type; and (b) means for turning said traction units from operating positions extended transversely of the main frame to transport positions extended longitudinally of the main frame.

4. A canal paving machine comprising:

(a) an elongated main frame having a slip form mountable from the underside thereof, (b) a pair of upright end frame structures for supporting said main frame above and transversely of a ditch to be paved each of which has an upright mounting plate extended transversely of the main frame, (c) coacting means on the main frame and on the mounting plate of one of said end frame structures movably supporting said one end frame structure for adjustment longitudinally of the main frame, (d) each end frame structure including a front traction unit and a rear traction unit, and a lower vertically adjustable means mounted on and projected upwardly from each of said traction units, (e) means movably connecting together the lower vertically adjustable means on a front traction unit and associated rear traction unit for adjustable movement of one of said traction units transversely of the main frame, and (f) an upper vertically adjustable means extended between and connected to each mounting plate and adjacent movable connecting means, (g) said upper vertically adjustable means being retracted during a paving operation whereby said main frame is vertically movable relative to the traction units by said lower vertically adjustable means, and when a slip form is to be mounted on or removed therefrom said main frame being movable to a maximum elevated position by adjustment of the upper vertically adjustable means and lower vertically adjustable means to the fully extended positions therefor.

5. A canal paving machine comprising:

(a) an elongated main frame having a slip form mountable from the under side thereof, (b) a pair of end frame structures for supporting said main frame above and transversely of a ditch to be paved, each end frame structure including an upright transverse mounting plate, (c) means securing one of said mounting plates to one end of said main frame, (d) means movably supporting the other mounting plate on the opposite end of the main frame for longitudinal adjustable movement toward and away from the one end thereof to vary the length of the main frame, (e) a pair of upper vertically adjustable units secured to the outer side of each mounting plate in a spaced relation transversely of the main frame, with each upper vertically adjustable unit having an adjustable member movable downwardly from an associated mounting plate, (f) a transverse frame member for each end frame structure connected to and extended between the adjustable members of said pair of upper vertically adjustable units, (g) a front traction unit and a rear traction unit for each end frame structure, (h) a front vertically adjustable unit extended between and connected to each front traction unit and adjacent transverse frame member, (i) a rear vertically adjustable unit connected to and projected upwardly from each rear traction unit, and (j) means movably supporting each front adjustable unit on an adjacent transverse frame member for movement toward and away from an associated rear traction unit, (k) said pair of upper adjustable units during a paving operation, being retracted whereby said main frame is vertically movable relative to the traction units by said front and rear vertically adjustable units and, when a slip form is to be mounted on or removed therefrom, being moved to a maximum elevation by the extension of said pair of upper vertically adjustable units, and said front and rear vertically adjustable units.

* * * * *